US011309153B2

(12) United States Patent
Sasaki et al.

(10) Patent No.: US 11,309,153 B2
(45) Date of Patent: Apr. 19, 2022

(54) CONTACT SWITCHING DEVICE

(71) Applicant: OMRON Corporation, Kyoto (JP)

(72) Inventors: Jun Sasaki, Kumamoto (JP); Kazuhiro Tsutsui, Kumamoto (JP); Hiroyuki Harimochi, Kumamoto (JP); Shintaro Wada, Kumamoto (JP); Yuki Muto, Kumamoto (JP); Kazuhiro Ikemoto, Yasu (JP); Keisuke Kihara, Okayama (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 16/978,771

(22) PCT Filed: Jan. 16, 2019

(86) PCT No.: PCT/JP2019/001098
§ 371 (c)(1),
(2) Date: Sep. 8, 2020

(87) PCT Pub. No.: WO2019/176268
PCT Pub. Date: Sep. 19, 2019

(65) Prior Publication Data

US 2021/0043404 A1 Feb. 11, 2021

(30) Foreign Application Priority Data

Mar. 13, 2018 (JP) ..... JP2018-045434

(51) Int. Cl.
*H01H 50/04* (2006.01)
*H01H 50/14* (2006.01)
(Continued)

(52) U.S. Cl.
CPC ..... *H01H 50/04* (2013.01); *H01H 50/14* (2013.01); *H01H 50/44* (2013.01); *H01H 50/58* (2013.01)

(58) Field of Classification Search
CPC ..... H01H 50/04; H01H 1/06; H01H 50/14; H01H 50/38; H01H 50/54; H01H 50/44; H01H 50/58
See application file for complete search history.

(56) References Cited

U.S. PATENT DOCUMENTS 8,193,881 B2 * 6/2012 Yuba ..... H01H 9/443 335/78
8,354,906 B2 * 1/2013 Nagura ..... H01H 9/443 335/201
(Continued)

FOREIGN PATENT DOCUMENTS

CN 101271800 A 9/2008
CN 101388303 A 3/2009
(Continued)

OTHER PUBLICATIONS

The International Search Report of International Application No. PCT/JP2019/001098 dated Mar. 19, 2019.
(Continued)

*Primary Examiner* — Bernard Rojas
(74) *Attorney, Agent, or Firm* — Shinjyu Global IP

(57) ABSTRACT

The contact switching device includes a first terminal, a first contact, a second terminal, and a base. The first contact is attached to the first terminal. The base includes a first attachment portion, a second attachment portion, and a groove portion. The first terminal is attached to the first attachment portion. The second terminal is attached to the second attachment portion. The groove portion is arranged between the first attachment portion and the second attach-
(Continued)

ment portion. The groove portion has a shape in which the inside is larger than the entrance.

9 Claims, 12 Drawing Sheets

(51) Int. Cl.
*H01H 50/44* (2006.01)
*H01H 50/58* (2006.01)

(56) References Cited

U.S. PATENT DOCUMENTS

| | | | | |
|---|---|---|---|---|
| 10,679,812 | B2 * | 6/2020 | Tanaka | H01H 50/14 |
| 2004/0119566 | A1 * | 6/2004 | Sanada | H01H 50/56 335/128 |
| 2005/0040920 | A1 * | 2/2005 | Takano | H01H 50/026 335/128 |
| 2017/0133183 | A1 * | 5/2017 | Hasegawa | H01H 50/02 |

FOREIGN PATENT DOCUMENTS

| | | | |
|---|---|---|---|
| CN | 104916499 | A | 9/2015 |
| CN | 106098475 | A | 11/2016 |
| CN | 106298370 | A | 1/2017 |
| CN | 106537548 | A | 3/2017 |
| JP | 46-4930 | Y1 | 2/1971 |
| JP | 48-12129 | Y1 | 4/1973 |
| JP | 48-34854 | Y1 | 10/1973 |
| JP | 54-21562 | A | 2/1979 |
| JP | 2010-123545 | A | 6/2010 |
| JP | 2011-14401 | A | 1/2011 |
| WO | 2018/043159 | A1 | 3/2018 |

OTHER PUBLICATIONS

The Written Opinion of the International Searching Authority of International Application No. PCT/JP2019/001098 dated Mar. 19, 2019.

The Office Action of the corresponding Chinese application No. 201980016582.3 dated Jan. 26, 2022.

* cited by examiner

CONTACT SWITCHING DEVICE

CROSS-REFERENCE TO RELATED APPLICATION

This application is the U.S. National Phase of International Application No. PCT/JP2019/001098, filed on Jan. 16, 2019. This application claims priority to Japanese Patent Application No. 2018-045434, filed Mar. 13, 2018. The contents of those applications are incorporated by reference herein in their entireties.

FIELD

The present invention relates to a contact switching device.

BACKGROUND

In a contact switching device such as a relay disclosed in Japanese Patent Application Publication No. 2010-123545A, a part of a contact is consumed by causes such as melting and scattering due to arc energy when the contact is opened and closed. Powder waste may be generated by such a consumption of the contact, and may be deposited inside the contact switching device. The powder waste hinders the electrical insulation between the terminals and causes insulation failure.

SUMMARY

Conventionally, in order to prevent the insulation failure, an outer dimension of the contact switching device is enlarged to increase the creepage distance between terminals, thereby ensuring a large insulation distance. However, in that case, the contact switching device increases in size. Therefore, it is not easy to prevent insulation failure while suppressing increase in size of the contact switching device.

An object of the present invention is to prevent the insulation failure due to the powder waste of contacts while suppressing the increase in the size of the contact switching device.

The contact switching device according to an aspect of the present disclosure includes a first terminal, a first contact, a second terminal, and a base. The first contact is attached to the first terminal. The base includes a first attachment portion, a second attachment portion, and a groove portion. The first terminal is attached to the first attachment portion. The second terminal is attached to the second attachment portion. The groove portion is arranged between the first attachment portion and the second attachment portion. The groove has a shape in which an inside is larger than an entrance.

In the contact switching device according to this aspect, the groove portion provided in the base increases the creepage distance between the first terminal and the second terminal increases. Further, since the groove portion has a shape in which the inside is larger than the entrance, it is possible to further increase the creepage distance while suppressing an increase in the size of the contact switching device. Further, since the inside of the groove portion is larger than the entrance, even if the powder waste of the contact falls inside the groove portion, it hardly occurs that the powder waste covers a bottom surface of the groove portion entirely. Therefore, even if the powder waste is deposited on the bottom surface of the groove portion, a large insulation distance can be secured. Further, since the powder waste is unlikely to be deposited on a side surface and an upper surface inside the groove portion, even if the powder waste covers the bottom surface of the groove portion entirely, a large insulation distance can be secured. As described above, in the contact switching device according to the present aspect, it is possible to prevent the insulation failure due to the powder waste of the contacts while suppressing the increase in the size of the contact switching device.

The inside of the groove portion may have a shape that is enlarged than the entrance toward a side of the first terminal. In this case, the creepage distance between the first terminal and the second terminal can be increased while suppressing the increase in the size of the contact switching device.

The inside of the groove portion may have a shape that is enlarged than the entrance toward a side of the second terminal. In this case, the creepage distance between the first terminal and the second terminal can be increased while suppressing the increase in the size of the contact switching device.

The contact switching device may further include a case. The case may define an internal space, which accommodates the first contact, between the case and the base. The entrance of the groove portion may be arranged to face the internal space. In this case, even if the powder waste of the contact generated in the internal space falls inside the groove portion, a large insulation distance can be secured due to the shape of the groove portion described above.

When viewed from a direction in which the first contact is arranged with respect to the base, at least a part of the first contact may overlap with the groove portion. In this case, the groove portion is arranged at a position where the powder waste tends to fall. As a result, it is possible to more effectively prevent the insulation failure due to the powder waste of the contact.

An internal surface of the groove portion may include a bottom surface and an upper surface facing the bottom surface in the groove portion. The upper surface may be inclined with respect to the bottom surface. In this case, it is possible to increase the size of the upper surface of the groove portion in which the powder waste is unlikely to adhere. Thereby, the insulation distance can be increased.

The internal surface of the groove portion may further include an inner side surface connecting the upper surface and the bottom surface. The upper surface may be inclined so that the distance from the bottom surface increases from the inner side surface toward the entrance. In this case, it is possible to increase the size of the upper surface of the groove portion in which the powder waste is unlikely to adhere. Thereby, the insulation distance can be increased.

The base may be made of resin. In this case, since the groove portion reduces the thickness of the base, deformation of the base during forming can be mitigated. Therefore, the groove portion can achieve the effects of securing the insulation distance and of stabilizing the dimension of the base which is a resin formed component.

The groove portion may extend toward a side surface of the base along a surface of the base and may open at the side surface of the base. In this case, forming with a mold becomes easy.

The groove portion may have a shape in which the width increases toward the side surface of the base. In this case, release from the mold becomes easy.

The bottom surface of the groove portion may be inclined so that a distance from the entrance increases toward the side surface of the base. In this case, release from the mold becomes easy.

The contact switching device may further include a movable contact, a movable spring, and a drive unit. The movable contact may be arranged so as to face the first contact. The movable spring may be attached to the movable contact. The drive unit may operate the movable spring. The base may include a first base portion and a second base portion. The first base portion may include the first attachment portion, the second attachment portion, and the groove portion. The second base portion may support the drive unit. The first base portion and the second base portion may be integrally formed. In this case, the effect of stabilizing the dimension of the base with the groove portion is more effective.

The first base portion and the second base portion may be separate. In this case, it becomes easy to form the groove portion using the mold. This can give a higher degree of flexibility to the shape of the groove portion.

DETAILED DESCRIPTION

Figure 1:
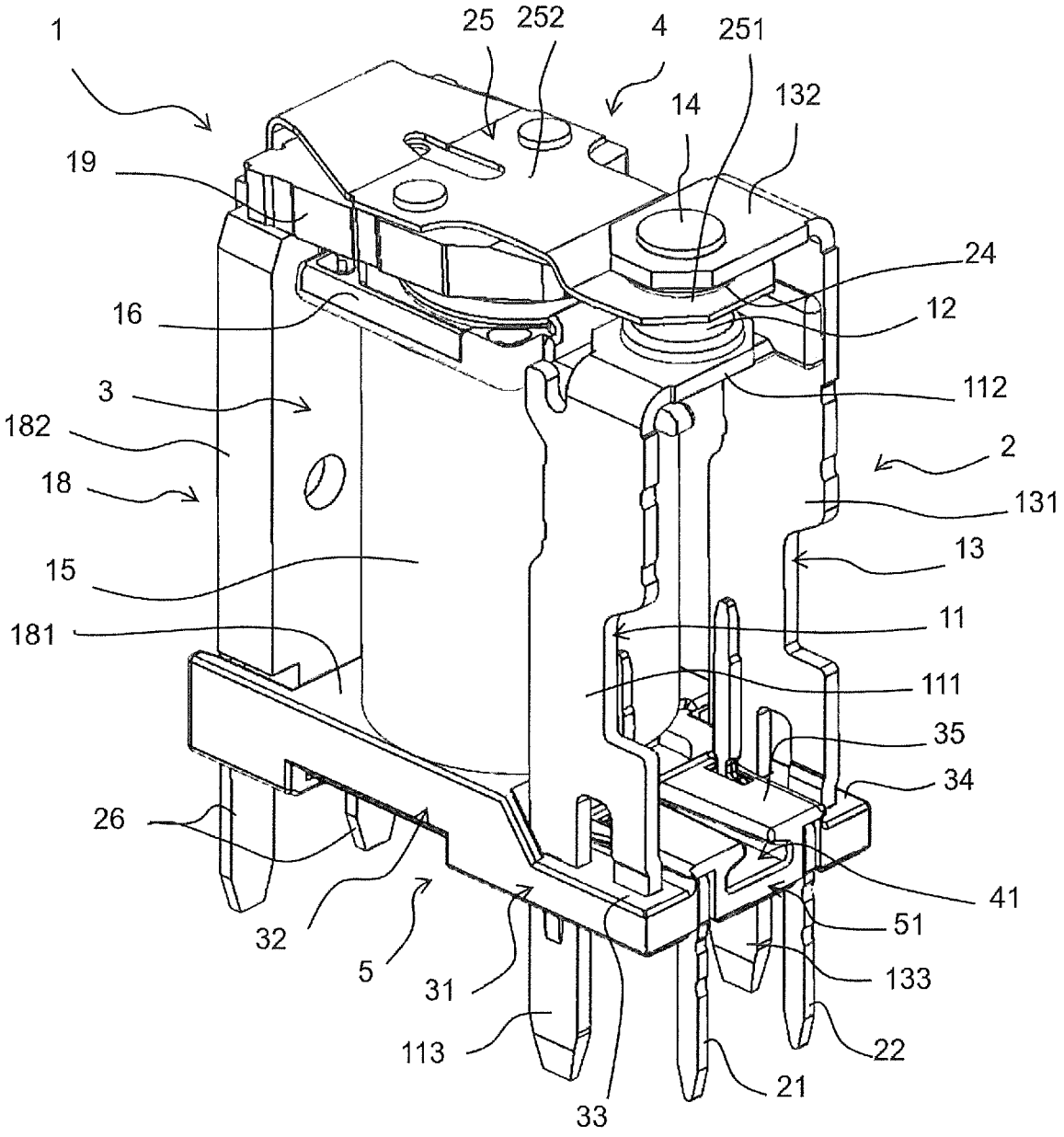
FIG. 1 is a perspective view of a contact switching device according to an embodiment.
Figure 2:
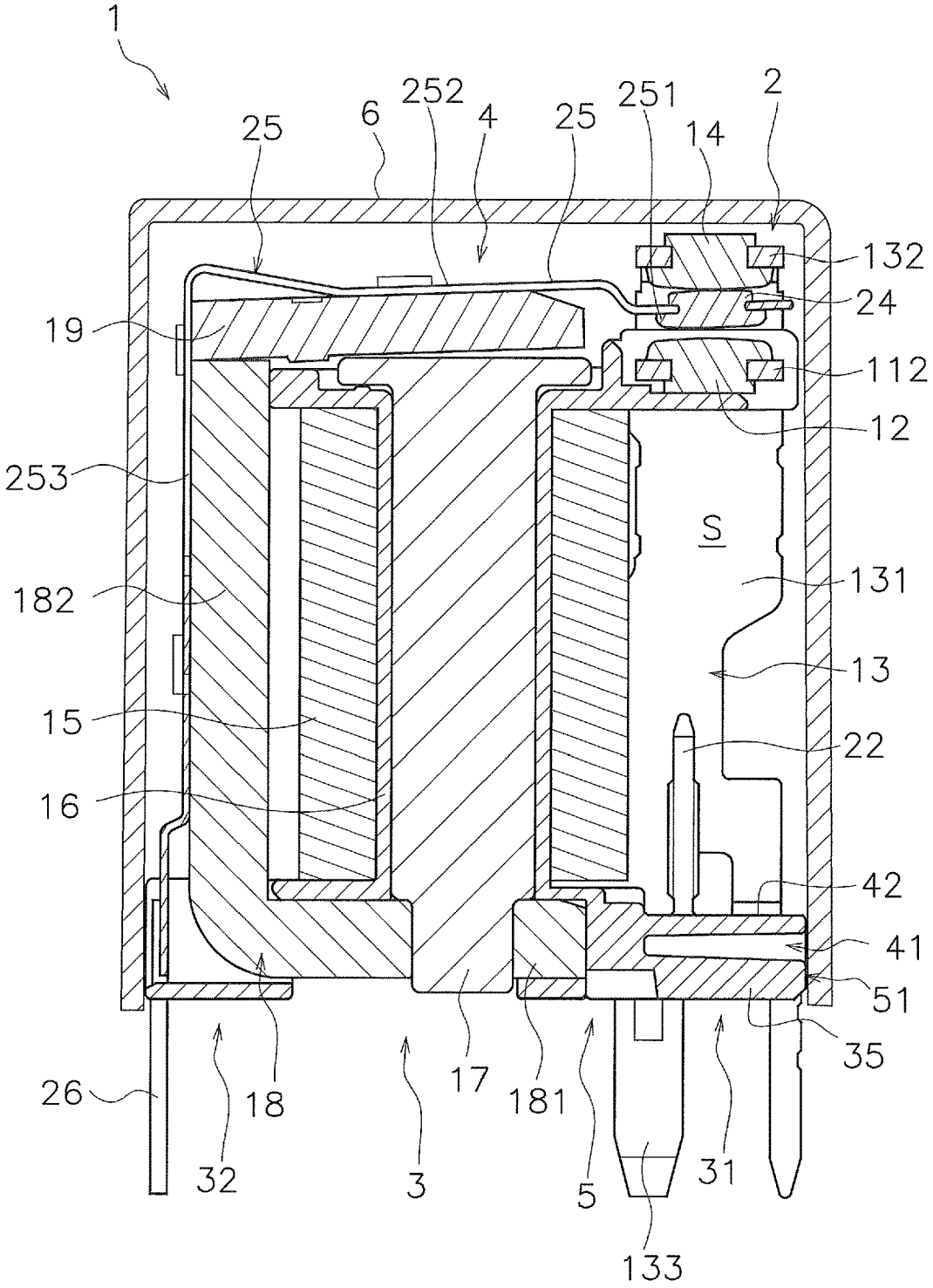
FIG. 2 is a front view of the contact switching device.
Figure 3:
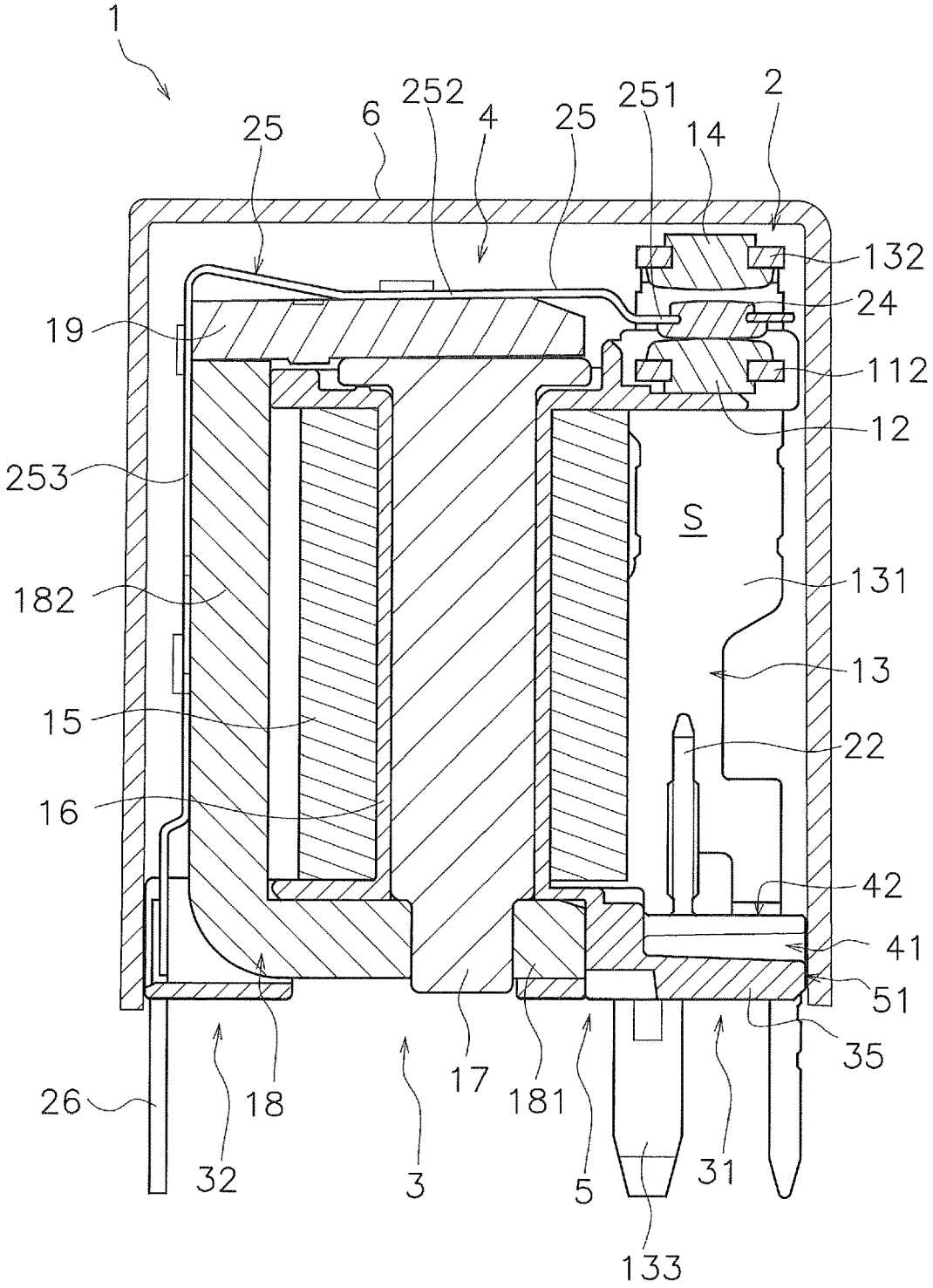
FIG. 3 is a front view of the contact switching device.
Figure 4:
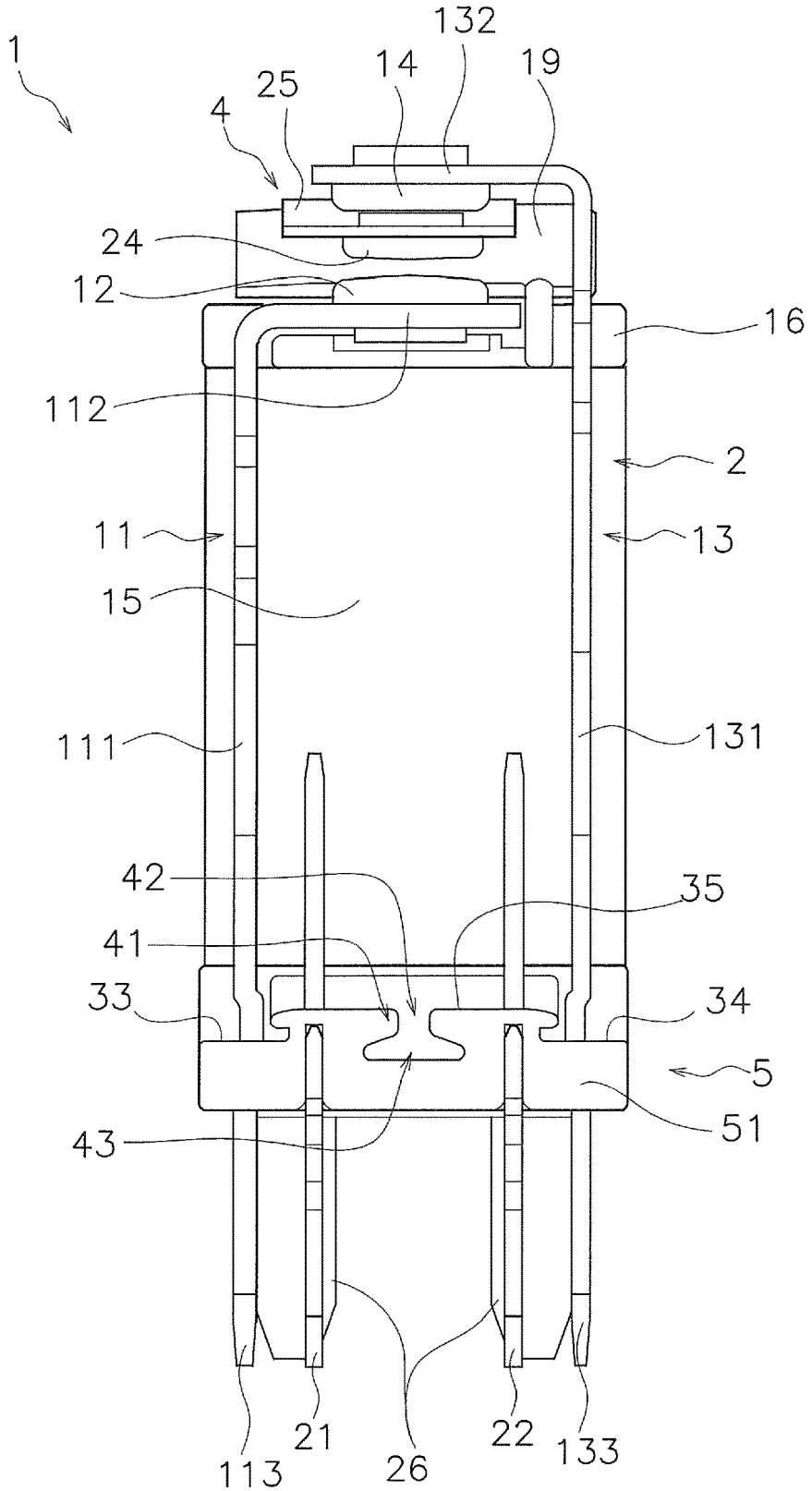
FIG. 4 is a side view of the contact switching device.

Hereinafter, an example of the contact switching device according to the embodiment will be described with reference to the drawings. FIG. 1 is a perspective view showing a contact switching device 1. FIGS. 2 and 3 are front views of the contact switching device 1. FIG. 4 is a side view of the contact switching device 1. As illustrated in FIGS. 1 to 4, the contact switching device 1 includes a fixed contact portion 2, a drive unit 3, a movable contact portion 4, a base 5, and a case 6. The case 6 is omitted in FIGS. 1 and 4.

The fixed contact portion 2 includes a first terminal 11, a first fixed contact 12, a second terminal 13, and a second fixed contact 14. The first terminal 11 and the second terminal 13 are made of conductive material. The first terminal 11 and the second terminal 13 are supported by the base 5.

In the following description, the direction in which the first terminal 11 and the second terminal 13 are arranged with respect to the base 5 is referred to as "upper" and the opposite direction is referred to as "lower". However, the definitions of these directions are used for convenience of description, and do not limit the arrangement direction of the contact switching device 1.

The first terminal 11 and the second terminal 13 extend upward from the base 5. The first terminal 11 includes a first main body portion 111 and a first contact attachment portion 112. The first terminal 11 has a shape bended between the first main body portion 111 and the first contact attachment portion 112. The first main body portion 111 is supported by the base 5 and extends upward from the base 5. The tip 113 of the first main body portion 111 projects from the base 5 to the outside of the contact switching device 1. The first contact attachment portion 112 extends in a direction approaching the second terminal 13.

The second terminal 13 includes a second main body portion 131 and a second contact attachment portion 132. The second terminal 13 has a shape bended between the second main body portion 131 and the second contact attachment portion 132. The second main body portion 131 is supported by the base 5 and extends upward from the base 5. The tip 133 of the second main body portion 131 projects from the base 5 to the outside of the contact switching device 1. The second contact attachment portion 132 extends in a direction approaching the first terminal 11. The first contact attachment portion 112 is arranged between the base 5 and the second contact attachment portion 132 in the up-down direction.

The first fixed contact 12 is attached to the first terminal 11. The second fixed contact 14 is attached to the second terminal 13. The first fixed contact 12 and the second fixed contact 14 are made of conductive material. The first fixed contact 12 is attached to the first contact attachment portion 112. The second fixed contact 14 is attached to the second contact attachment portion 132. The first fixed contact 12 is arranged between the base 5 and the second fixed contact 14 in the up-down direction.

The drive unit 3 generates a driving force for operating the movable contact portion 4. Specifically, the drive unit 3 is an electromagnet and generates an electromagnetic force that operates the movable contact portion 4. The drive unit 3 is attached to the base 5. As illustrated in FIGS. 2 and 3, the drive unit 3 includes a coil 15, a bobbin 16, an iron core 17, a yoke 18, and a movable iron piece 19.

The coil 15 is wound around the bobbin 16. The axis of the coil 15 extends in the up-down direction. The coil terminals 21, 22 are connected to the coil 15. The coil terminals 21, 22 are supported by the base 5. The tips of the coil terminals 21, 22 project from the base 5 to the outside of the contact switching device 1. The bobbin 16 is formed integrally with the base 5. The iron core 17 is inserted in the bobbin 16.

The yoke 18 has a shape bent in L-shape, and is connected to the iron core 17. Specifically, the yoke 18 has a yoke bottom portion 181 and a yoke side portion 182. The yoke bottom portion 181 is arranged below the coil 15. The lower end portion of the iron core 17 projects downward from the bobbin 16, and the yoke bottom portion 181 is connected to the lower end portion of the iron core 17. The yoke side portion 182 is arranged laterally of the coil 15. The yoke side portion 182 extends in the up-down direction. The movable iron piece 19 is rotatably supported in the upper end portion of the yoke 18. Specifically, the movable iron piece 19 is rotatably supported in the upper end portion of the yoke side portion 182. The movable iron piece 19 is arranged above the iron core 17.

The movable contact portion 4 includes a movable contact 24, a movable spring 25, and a terminal 26. The movable contact 24, the movable spring 25, and the terminal 26 are made of conductive material. The movable contact 24 is arranged between the first fixed contact 12 and the second fixed contact 14. The movable contact 24 is attached to the movable spring 25.

The movable spring 25 is made of elastic material. The movable spring 25 is a leaf spring. The movable spring 25 biases the movable iron piece 19 in a direction in which the movable iron piece 19 moves away from the iron core 17. The movable spring 25 biases the movable contact 24 in a direction in which the movable contact 24 is pressed against the second fixed contact 14. The movable spring 25 includes a contact attachment portion 251, a first spring body 252, and a second spring body 253. The movable spring 25 has a shape bended between the first spring body 252 and the second spring body 253.

The contact attachment portion 251 is located between the first fixed contact 12 and the second fixed contact 14. The movable contact 24 is attached to the contact attachment portion 251. The first spring body 252 is located above the movable iron piece 19. The first spring body 252 is connected to the movable iron piece 19. The second spring body 253 is arranged laterally of the yoke side portion 182. The second spring body 253 is connected to the yoke side portion 182. The terminal 26 projects from the base 5 to the outside of the contact switching device 1. The terminal 26 is connected to the second spring body 253.

The base 5 supports the fixed contact portion 2, the drive unit 3, and the movable contact portion 4. The base 5 is made of resin. As illustrated in FIGS. 2 and 3, the base 5 is covered with a case 6. The case 6 is made of resin, for example, but may be made of material other than resin. The first fixed contact 12, the second fixed contact 14, and the movable contact 24 are accommodated in the internal space S between the case 6 and the base 5.

Next, the operation of the contact switching device 1 will be described. When the coil 15 is not energized and the drive unit 3 is demagnetized, the movable iron piece 19 is not attracted to the iron core 17. Therefore, as illustrated in FIG. 2, the movable contact 24 is pressed against and contacts the second fixed contact 14 by the elastic force of the movable spring 25.

When the coil 15 is energized and the drive unit 3 is excited, the movable iron piece 19 is attracted to the iron core 17 and rotates around the upper end portion of the yoke 18 against the elastic force of the movable spring 25 (clockwise in FIG. 2). As a result, the movable contact 24 separates from the second fixed contact 14 and is pressed against and contacts the first fixed contact 12, as illustrated in FIG. 3.

On the contrary, in the state illustrated in FIG. 3, when the energization of the coil 15 is stopped and the drive unit 3 is demagnetized, the movable iron piece 19 rotates in the direction away from the iron core 17 by the elastic force of the movable spring 25 (counterclockwise in FIG. 3). Thereby, the movable contact 24 separates from the first fixed contact 12 and is pressed against and contacts the second fixed contact 14.

As described above, in the contact switching device 1, the movable contact 24 contacts the second fixed contact 14 and separates from the first fixed contact 12 when the drive unit 3 is in the demagnetized state. When the drive unit 3 is in the excited state, the movable contact 24 separates from the second fixed contact 14 and contacts the first fixed contact 12.

Figure 5:
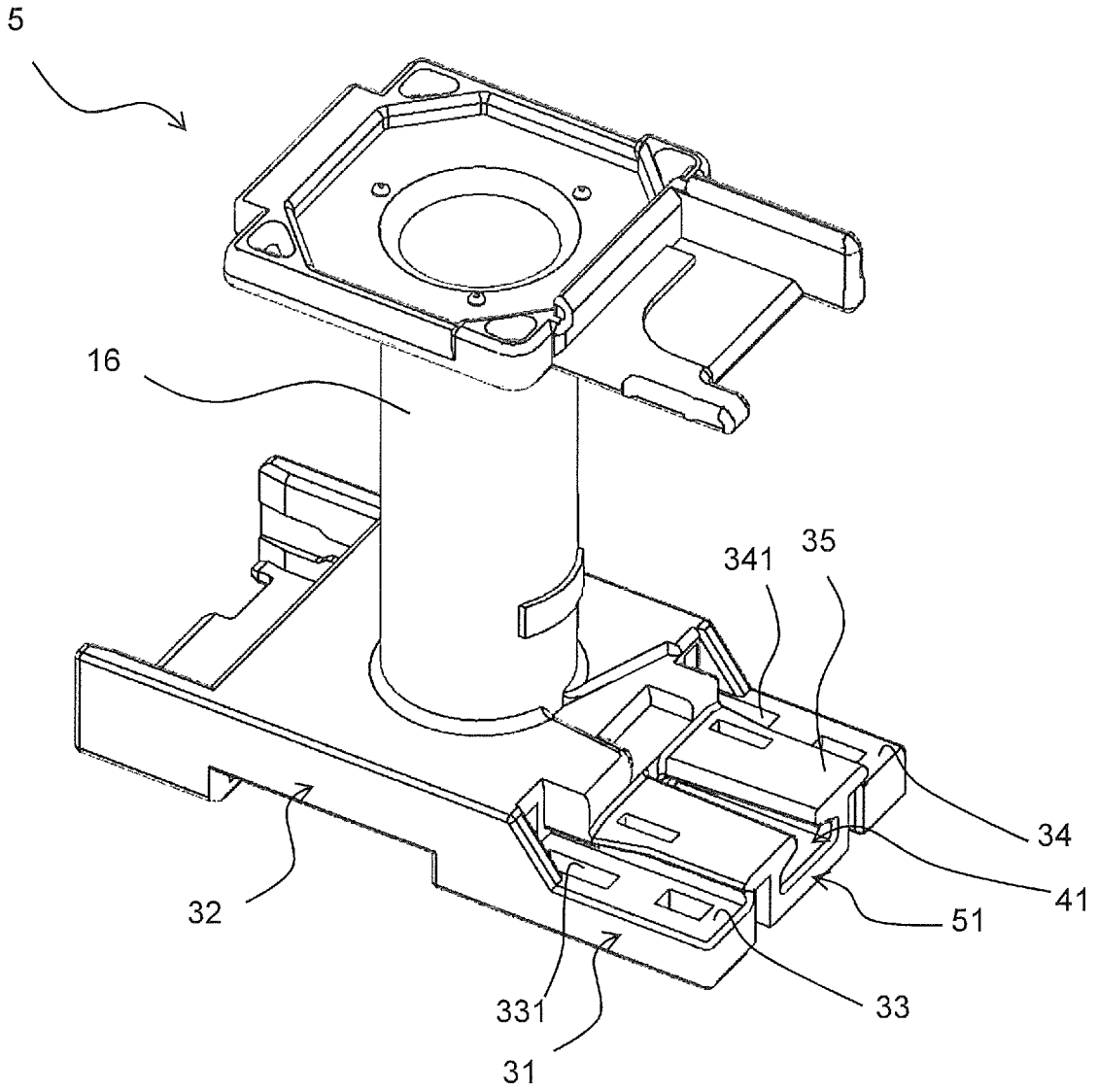
FIG. 5 is a perspective view of a base.

Next, the structure of the base 5 will be described in detail. FIG. 5 is a perspective view of the base 5. The base 5 includes a first base portion 31 and a second base portion 32. The first base portion 31 supports the fixed contact portion 2. The second base portion 32 supports the drive unit 3. The first base portion 31, the second base portion 32, and the bobbin 16 described above are integrally formed.

Figure 6:
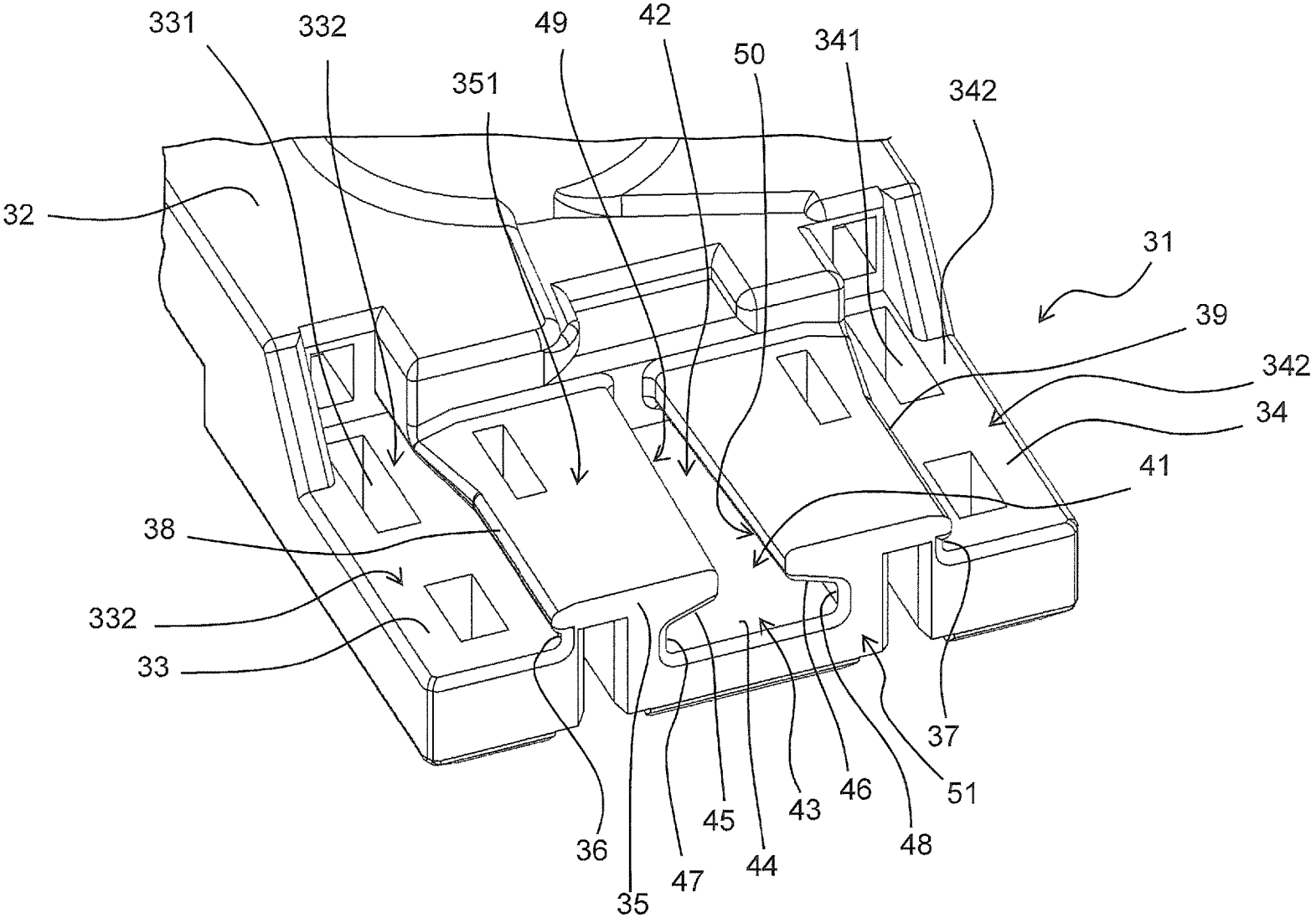
FIG. 6 is an enlarged perspective view of a first base portion.
Figure 7:
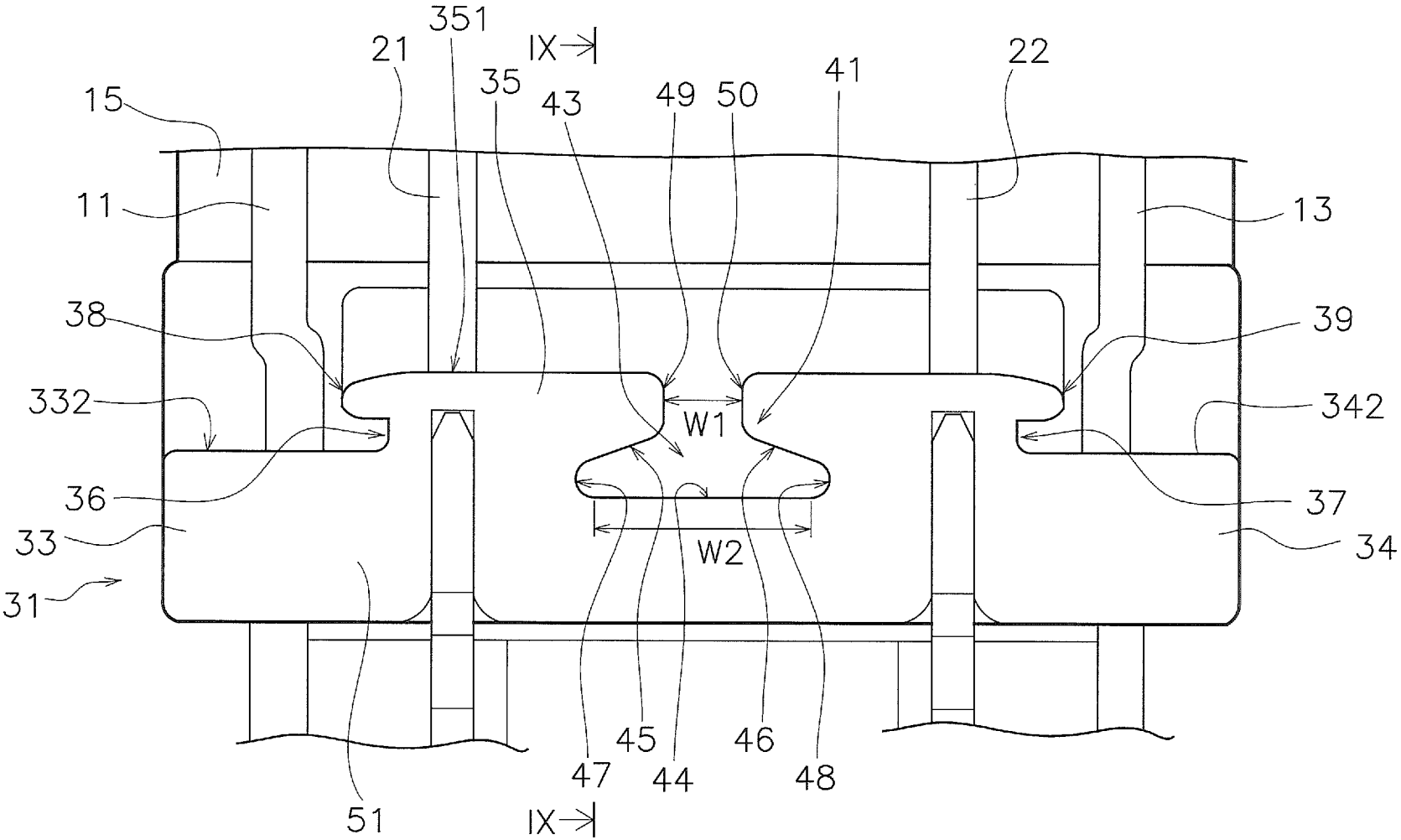
FIG. 7 is an enlarged side view of the first base portion.

FIG. 6 is an enlarged perspective view of the first base portion 31. FIG. 7 is an enlarged side view of the first base portion 31. The first base portion 31 includes a first attachment portion 33, a second attachment portion 34, and an intermediate portion 35. The first terminal 11 is attached to the first attachment portion 33. The second terminal 13 is attached to the second attachment portion 34. Specifically, the first attachment portion 33 is provided with a hole 331, and the first main body portion 111 of the first terminal 11 is inserted into the hole 331. The second attachment portion 34 is provided with a hole 341, and the second main body portion 131 of the second terminal 13 is inserted into the hole 341.

The intermediate portion 35 is arranged between the first attachment portion 33 and the second attachment portion 34. The upper surface 351 of the intermediate portion 35 is located above the upper surface 332 of the first attachment portion 33. The upper surface 351 of the intermediate portion 35 is located above the upper surface 342 of the second attachment portion 34.

The base 5 includes a first step portion 36 and a second step portion 37. The first step portion 36 is located between the first attachment portion 33 and the intermediate portion 35. The first step portion 36 projects upward from the upper surface 332 of the first attachment portion 33. The second step portion 37 is located between the second attachment portion 34 and the intermediate portion 35. The second step portion 37 projects upward from the upper surface 342 of the second attachment portion 34. The first step portion 36 and the second step portion 37 pass between the first terminal 11 and the second terminal 13 and extend to the side surface 51 of the base 5.

The intermediate portion 35 includes a first edge portion 38 and a second edge portion 39. The first edge portion 38 projects from the first step portion 36 in the direction toward the first terminal 11. The second edge portion 39 projects from the second step portion 37 toward the second terminal 13. The first edge portion 38 and the second edge portion 39 extend between the first terminal 11 and the second terminal 13 and extend to the side surface 51 of the base 5.

A groove portion 41 is provided in the intermediate portion 35. The groove portion 41 is located between the first attachment portion 33 and the second attachment portion 34. The groove portion 41 is located between the first terminal 11 and the second terminal 13. The groove portion 41 is recessed downward from the surface of the base 5. The groove portion 41 is recessed downward from the upper surface 351 of the intermediate portion 35.

The groove portion 41 is arranged between the first terminal 11 and the second terminal 13. The groove portion 41 is arranged between the first edge portion 38 and the second edge portion 39. The groove portion 41 passes between the first terminal 11 and the second terminal 13 and extends to the side surface 51 of the base 5. The groove portion 41 opens at the side surface 51 of the base 5. The groove portion 41 has a shape in which the inside 43 is larger than the entrance 42.

Specifically, the inside 43 of the groove portion 41 has a shape that is enlarged than the entrance 42 toward a side of the first terminal 11. The inside 43 of the groove portion 41 has a shape that is enlarged than the entrance 42 toward a side of the second terminal 13. The entrance 42 of the groove portion 41 is arranged to face the internal space S. The entrance 42 of the groove portion 41 opens toward upward.

Figure 8:
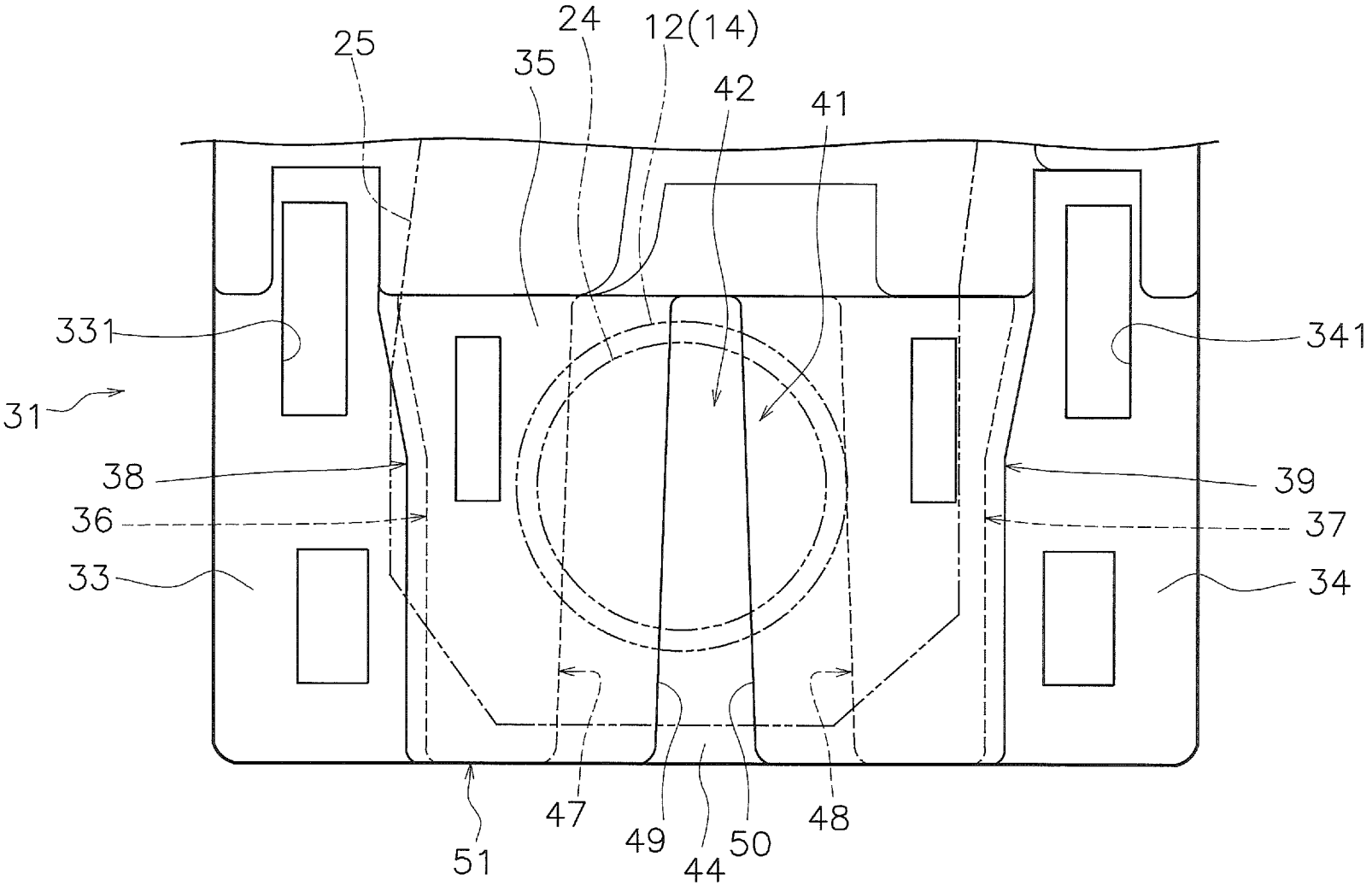
FIG. 8 is an enlarged top view of the first base portion.

FIG. 8 is a top view of the first base portion 31. In FIG. 8, the chain double-dashed line indicates the positions of the first fixed contact 12, the second fixed contact 14, the movable contact 24, and the movable spring 25. As illustrated in FIG. 8, at least a part of the first fixed contact 12 and the second fixed contact 14 overlaps with the groove portion 41 when viewed in the up-down direction. When viewed in the up-down direction, at least a part of the movable contact 24 overlaps the groove portion 41. When viewed in the vertical direction, at least a part of the contact attachment portion 251 of the movable spring 25 overlaps the groove portion 41.

As illustrated in FIG. 7, the internal surface of the groove portion 41 includes a bottom surface 44, a first upper surface 45, a second upper surface 46, a first inner side surface 47, and a second inner side surface 48. The bottom surface 44 is located below the entrance 42. The width W2 of the bottom surface 44 is larger than the width W1 of the entrance 42.

The first upper surface 45 and the second upper surface 46 are located above the bottom surface 44 and face the bottom surface 44 in the inside 43 of the groove portion 41. The first inner side surface 47 connects the first upper surface 45 and the bottom surface 44. The second inner side surface 48 connects the second upper surface 46 and the bottom surface 44.

The first upper surface 45 is inclined so that the distance from the bottom surface 44 increases from the first inner side surface 47 toward the entrance 42. The second upper surface 46 is inclined so that the distance from the bottom surface 44 increases from the second inner side surface 48 toward the entrance 42.

The entrance 42 of the groove portion 41 includes a first groove edge portion 49 and a second groove edge portion 50. The first groove edge portion 49 is located on the side of the first terminal 11 at the entrance 42 of the groove portion 41. The second groove edge portion 50 is located on the side of the second terminal 13 at the entrance 42 of the groove portion 41. The first inner side surface 47 is located closer to the first terminal 11 than the first groove edge portion 49. The second inner side portion 48 is located closer to the second terminal 13 than the second groove edge portion 50.

As illustrated in FIG. 8, the groove portion 41 has a shape inclined so that the width thereof increases toward the side surface 51 of the base 5. Specifically, the first groove edge portion 49 and the second groove edge portion 50 are inclined so that the distance therebetween increases toward the side surface 51 of the base 5. The first inner side surface 47 and the second inner side portion 48 are inclined so that the distance therebetween increases toward the side surface 51 of the base 5.

Figure 9:
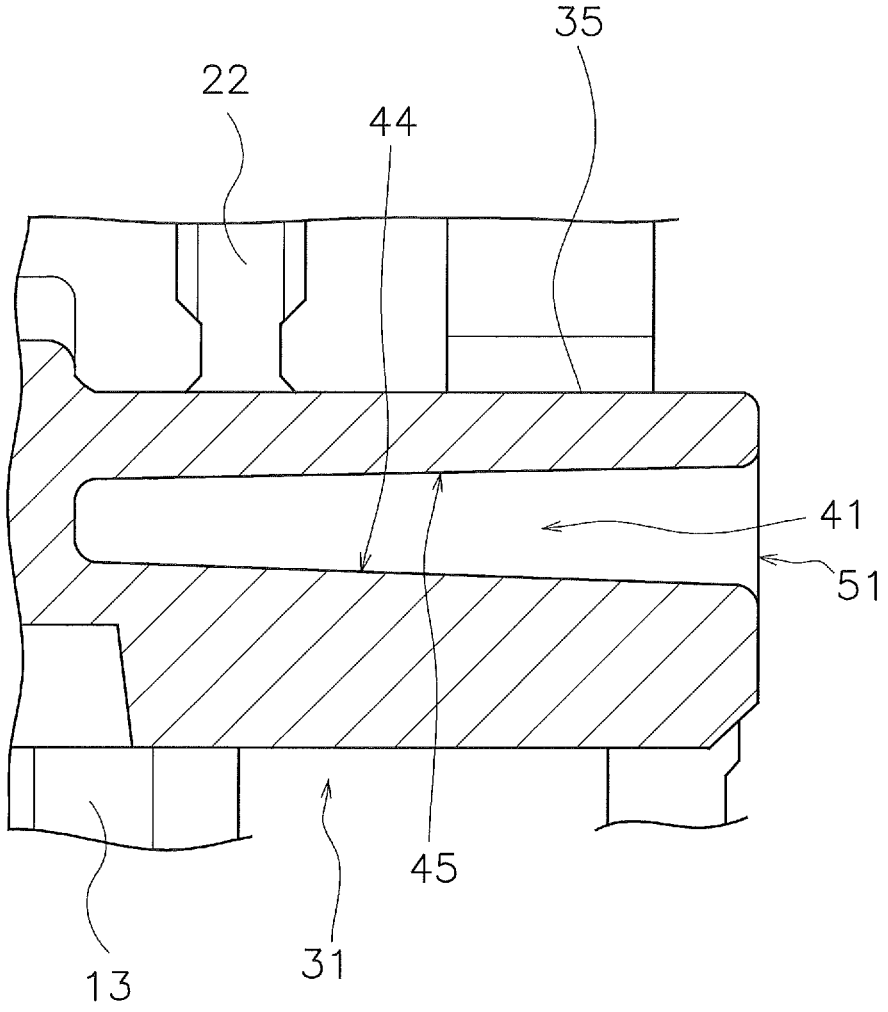
FIG. 9 is a sectional view taken along a line IX-IX in FIG. 7.

FIG. 9 is a sectional view taken along the line XI-XI in FIG. 7. As illustrated in FIG. 9, the bottom surface 44 of the groove portion 41 is inclined downward toward the side surface 51 of the base 5. The bottom surface 44 is inclined so that the distance from the entrance 42 increases toward the side surface 51 of the base 5. The first upper surface 45 is inclined upward toward the side surface 51 of the base 5. Although not illustrated, the second upper surface 46 also is inclined upward toward the side surface 51 of the base 5, similarly to the first upper surface 45.

In the contact switching device 1 according to the present embodiment described above, the groove portion 41 provided in the base 5 increases the creepage distance between the first terminal 11 and the second terminal 13. Further, since the groove portion 41 has a shape in which the inside 43 is larger than the entrance 42, it is possible to increase the creepage distance while suppressing the increase in the size of the base 5. As a result, it is possible to suppress the increase in the size of the contact switching device 1. Further, since the inside 43 of the groove portion 41 is larger than the entrance 42, even if the powder waste of the contacts 12, 14, 24 falls into the inside 43 of the groove portion 41, it hardly occurs that the powder waste covers the bottom surface 44 of the groove portion 41 entirely. Therefore, even if the powder waste is deposited on the bottom surface 44 of the groove portion 41, a large insulation distance can be secured. Further, the powder waste is unlikely to be deposited on the inner side surfaces 47, 48 and the upper surfaces 45, 46 of the inside 43 of the groove portion 41. Therefore, even if the powder waste covers the bottom surface 44 of the groove portion 41 entirely, a large insulation distance can be secured.

Further, when the base 5 is made of resin, if the base 5 has a large thickness, the deformation due to shrinkage during forming becomes large. However, in the contact switching device 1 according to the present embodiment, the groove portion 41 reduces the thickness of the base 5. Therefore, the deformation of the base 5 during forming can be mitigated. Therefore, the groove portion 41 can achieve the effects of securing the insulation distance and of stabilizing the dimension of the base 5 which is a resin formed component.

At least a part of the first fixed contact 12 and the second fixed contact 14 overlaps the groove portion 41 when viewed in the up-down direction. Therefore, the groove portion 41 is arranged at a position where the powder waste of the contacts 12, 14, 24 tends to fall. Therefore, the insulation failure due to the powder waste can be suppressed more effectively.

The upper surfaces 45, 46 of the groove portion 41 are inclined with respect to the bottom surface 44. Therefore, the upper surfaces 45, 46 of the groove portion 41 to which the powder waste is unlikely to adhere can be enlarged. Thereby, the insulation distance can be increased.

The groove portion 41 opens at the side surface 51 of the base 5. Therefore, it becomes easy to form the base 5 with a mold. The groove portion 41 has a shape in which the width increases toward the side surface 51 of the base 5. The bottom surface 44 of the groove portion 41 is inclined so that the distance from the entrance 42 increases toward the side surface 51 of the base 5. Therefore, release from the mold becomes easy.

In the base 5, the first base portion 31 and the second base portion 32 are integrally formed. Therefore, the effect of stabilizing the dimension of the base 5 by the groove portion 41 is more effective.

Although one embodiment of the present invention has been described above, the present invention is not limited to the above embodiment, and various modifications can be made without departing from the scope of the invention.

In the above embodiment, a relay is illustrated as an example of the contact switching device, but the contact switching device is not limited to the relay, and may be another device such as a switch.

The configuration of the fixed contact portion 2 may be changed. For example, the shape or the arrangement of the first terminal 11 and the second terminal 13 may be changed. Alternatively, the contact structure of the contact switching device 1 may be a 1A contact specification in which the second fixed contact 14 is omitted. The configuration of the drive unit 3 may be changed. For example, the shape or arrangement of the coil 15 may be changed. The shape or arrangement of the movable iron piece 19 or the yoke 18 may be changed. The configuration of the movable contact portion 4 may be changed. For example, the shape or arrangement of the movable spring 25 may be changed. The shape or arrangement of the movable contact 24 may be changed.

The configuration of the base 5 may be changed. For example, the shape or arrangement of the groove portion 41 may be changed. The groove portion 41 does not need to open on the side surface 51 and may be closed. The base 5 is not limited to being made of resin and may be made of another material. The shape or arrangement of the first attachment portion 33, the second attachment portion 34, or the intermediate portion 35 may be changed.

Figure 10:
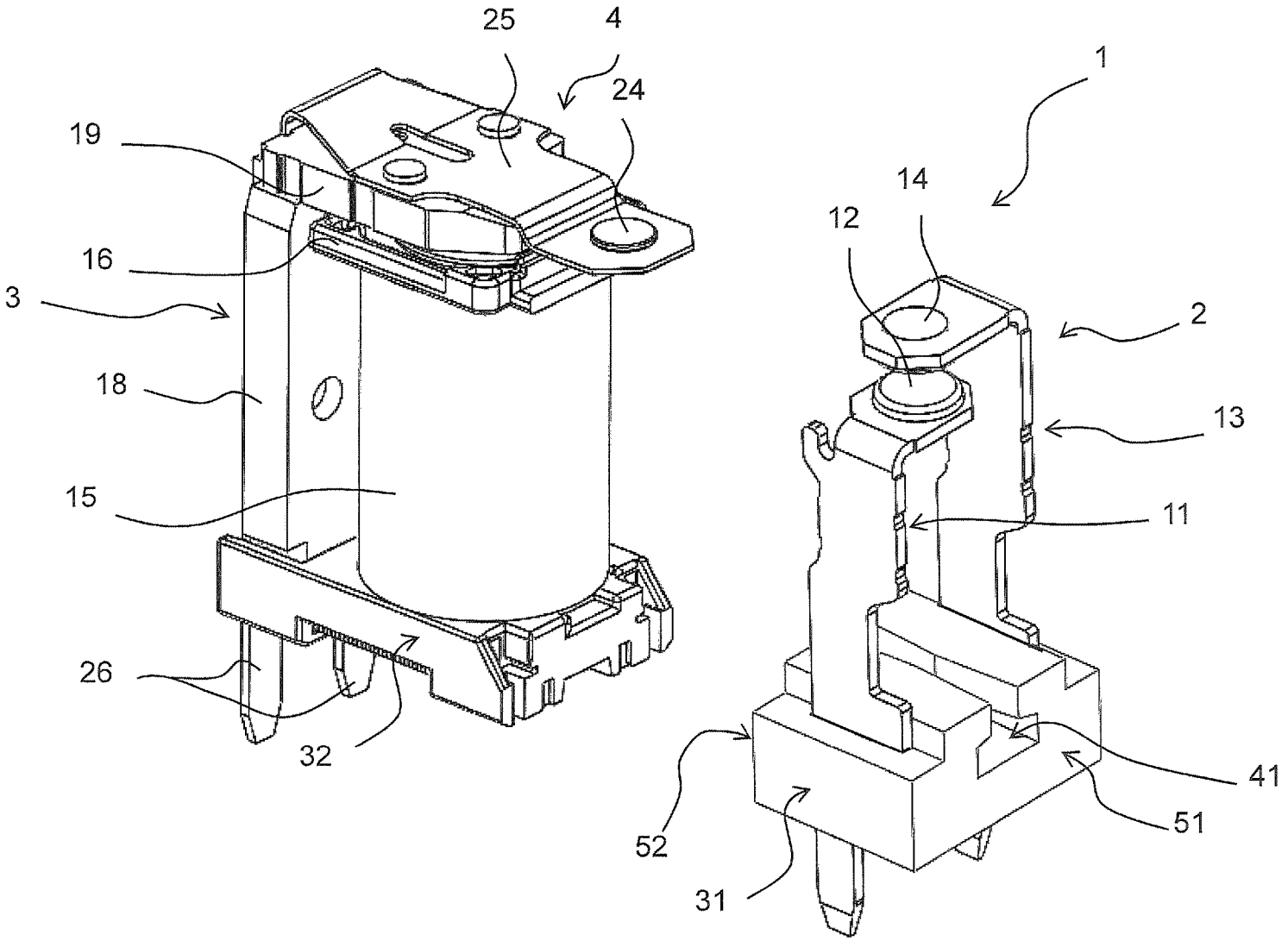
FIG. 10 is a perspective view showing a structure of a base according to a modified example.

FIG. 10 is a perspective view showing the structure of the base 5 according to the modification. As illustrated in FIG. 10, the first base portion 31 and the second base portion 32 may be separate. The first base portion 31 and the second base portion 32 may be connected to each other by a locking structure such as a locking claw or a fixing member such as a screw. In this case, it becomes easy to form the groove portion 41 using a mold. This can give a higher degree of flexibility to the shape of the groove portion.

Figure 11:
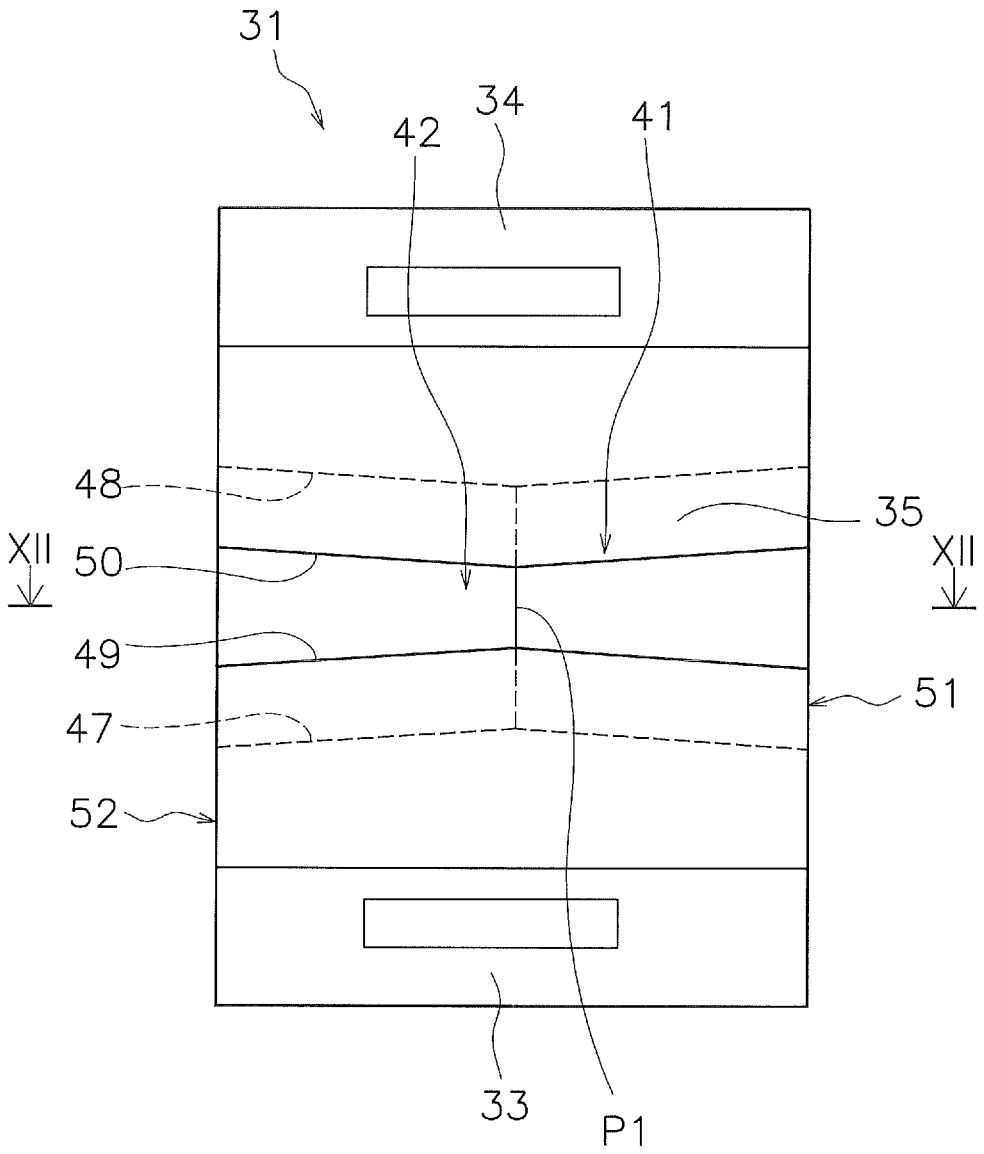
FIG. 11 is a top view showing a shape of a groove portion according to a modification.
Figure 12:
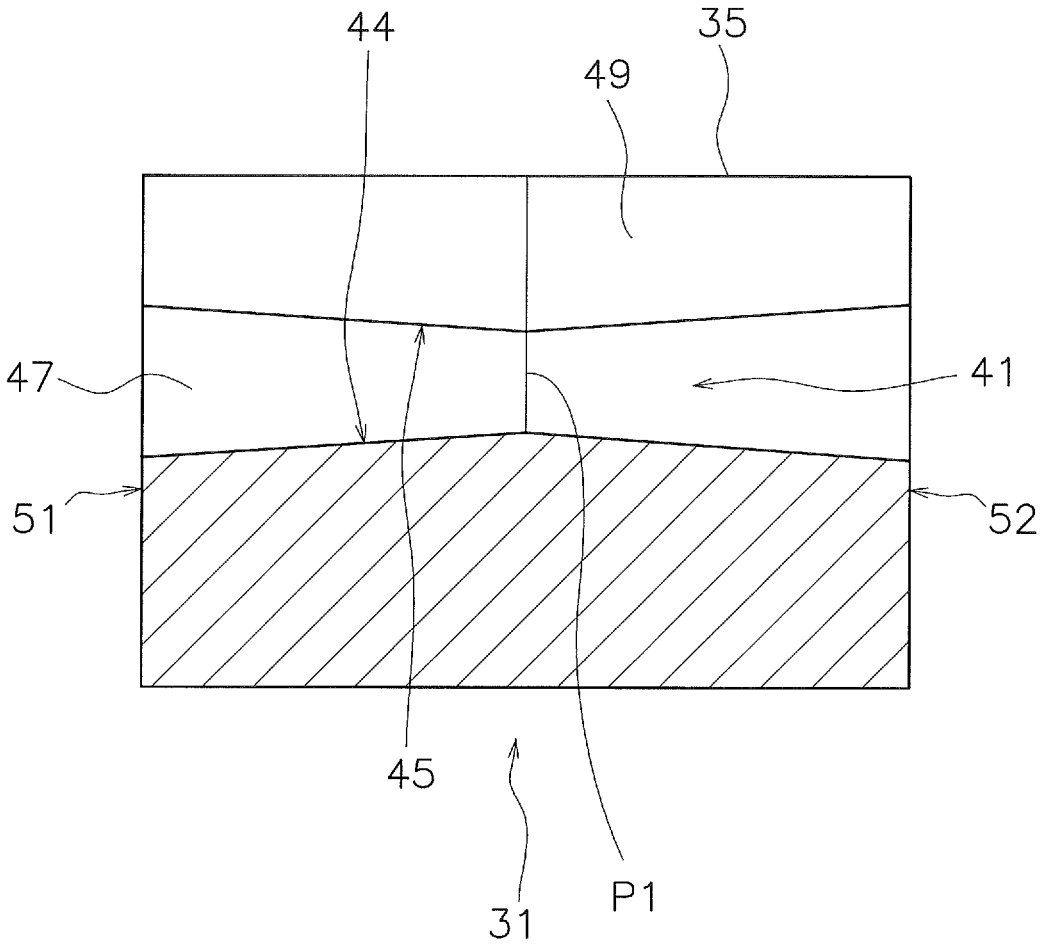
FIG. 12 is a sectional view taken along a line XII-XII in FIG. 11.

For example, FIG. 11 is a top view showing the shape of the groove portion 41 according to the modification. FIG. 12 is a side view showing the shape of the groove portion 41 according to the modification. The first base portion 31 includes the above-described side surface 51 (hereinafter, referred to as "first side surface 51") and the second side surface 52. The groove portion 41 may have a shape in which the width increases from the intermediate position P1 between the first side surface 51 and the second side surface 52 toward the first side surface 51 portion and the second side surface 52, respectively. The first inner side surface 47 and the second inner side portion 48 may have a shape in which the distance between the inner side surface 47 and the second inner side portion 48 increases from the intermediate position P1 between the first side surface 51 and the second side surface 52 toward the first side surface 51 and the second side surface 52, respectively.

The bottom surface 44 may be inclined downward from the intermediate position P1 between the first side surface 51 and the second side surface 52 toward the first side surface 51 and the second side surface 52, respectively. The first upper surface 45 may be inclined upward from the intermediate position P1 between the first side surface 51 and the second side surface 52 toward the first side surface 51 portion and the second side surface 52, respectively. Although illustration is omitted, similarly to the first upper surface 45, the second upper surface 46 may also be inclined upwardly from the intermediate position P1 between the first side surface 51 and the second side surface 52 to the first side surface 51 portion and the second side surface 52, respectively.

REFERENCE NUMERALS

3: Drive unit, 5: Base, 6: Case, 11 First terminal, 12: First fixed contact, 13: Second terminal, 14: Second fixed contact, 24: Movable contact, 25: Movable spring, 31: First base part, 32: Second base part, 33: First attachment portion, 34: Second attachment portion, 41: Groove portion, 44: Bottom surface, 45: First upper surface, 47: First inner side surface, S: Internal space

The invention claimed is:

1. A contact switching device comprising:
a first terminal;
a first contact attached to the first terminal;
a second terminal; and
a base made of resin, the base including a first attachment portion to which the first terminal is attached, a second attachment portion to which the second terminal is attached, and a groove portion arranged between the first attachment portion and the second attachment portion,
the groove portion having a shape in which an inside is larger than an entrance in a top surface of the base,
the groove portion extending toward a side surface of the base along a surface of the base and opens at the side surface of the base, the top surface being separate or different from the side surface, and
the groove portion further having a shape in which
a width increases toward the side surface of the base, or
a bottom surface of the groove portion is inclined so that a distance from the entrance increases toward the side surface of the base.

2. The contact switching device according to claim 1, wherein
the inside of the groove portion has a shape that is enlarged larger than the entrance toward the first terminal.

3. The contact switching device according to claim 1, wherein
the inside of the groove portion has a shape that is larger than the entrance toward the second terminal.

4. The contact switching device according to claim 1, further comprising
a case defining an internal space between the case and the base, the internal space accommodating the first contact, wherein
the entrance of the groove portion is arranged to face the internal space.

5. The contact switching device according to claim 1, wherein,
when viewed from a direction in which the first contact is arranged with respect to the base, at least a part of the first contact overlaps with the groove portion.

6. The contact switching device according to claim 1, wherein,
an internal surface of the groove portion includes the bottom surface and an upper surface facing the bottom surface in the groove portion, and
the upper surface is inclined with respect to the bottom surface.

7. The contact switching device according to claim 6, wherein,
the internal surface of the groove portion further includes an inner side surface connecting the upper surface and the bottom surface, and
the upper surface is inclined so that a distance from the bottom surface increases from the inner side surface toward the entrance.

8. The contact switching device according to claim 1, further comprising:
a movable contact arranged to face the first contact;
a movable spring attached to the movable contact; and
a drive unit configured to operate the movable spring, wherein
the base includes a first base portion including the first attachment portion, the second attachment portion, and the groove portion, and a second base portion supporting the drive unit, and
the first base portion and the second base portion are integrally formed.

9. The contact switching device according to claim 1, further comprising:
a movable contact arranged to face the first contact;
a movable spring attached to the movable contact; and
a drive unit configured to operate the movable spring, wherein the base includes a first base portion including the first attachment portion, the second attachment portion, and the groove portion, and a second base portion supporting the drive unit, and the first base portion and the second base portion are separate.

* * * * *